United States Patent [19]

Ratchford et al.

[11] Patent Number: 4,781,622

[45] Date of Patent: Nov. 1, 1988

[54] TRIAXIAL CONTACT ASSEMBLY FOR TERMINATION TO PRINTED CIRCUIT BOARDS AND THE LIKE

[75] Inventors: Lloyd G. Ratchford, Oneonta; Valentine J. Hemmer; Alan L. Davis, both of Unadilla, all of N.Y.

[73] Assignee: Amphenol Corporation, Wallingford, Conn.

[21] Appl. No.: 110,270

[22] Filed: Oct. 20, 1987

[51] Int. Cl.[4] ..... H01R 17/18

[52] U.S. Cl. ..... 439/585; 439/877; 439/741

[58] Field of Search ..... 439/578–585, 439/675, 877, 879, 63, 55, 78, 82, 83, 84, 741, 733, 869, 870

[56] References Cited

U.S. PATENT DOCUMENTS 4,431,254 2/1984 Cartesse ..... 439/675
4,666,231 5/1987 Sheesley et al. ..... 439/581
4,674,809 6/1987 Hollyday et al. ..... 439/63
4,708,666 11/1987 Fisher, Jr. ..... 439/580
4,710,138 12/1987 Bradley et al. ..... 439/63

OTHER PUBLICATIONS

IBM Tech. Discl. Bulletin, R. S. Maples, "Right Angle Electrical Connector", vol. 12, No. 6, 11/1969, p. 887.

*Primary Examiner*—David Pirlot
*Attorney, Agent, or Firm*—Bacon & Thomas

[57] ABSTRACT

A triaxial contact assembly for use with a ground plane electrical connector includes an outer conductor which is grounded to the ground plane of the connector. The intermediate and inner contacts of the triaxial contact assembly have printed circuit board tails on their ends. The arrangement is such that bonding of the insulators to the contacts is eliminated via a cap which holds all internal contact assembly components in place. The cap, in turn, is held in place by crimping the outer contact.

9 Claims, 1 Drawing Sheet

TRIAXIAL CONTACT ASSEMBLY FOR TERMINATION TO PRINTED CIRCUIT BOARDS AND THE LIKE

BACKGROUND OF THE INVENTION

Triaxial contact assemblies are required for use with particular ground plane electrical connectors, wherein the outer contact of the contact assembly is grounded to the ground plane of the connector. The intermediate and inner contacts of the contact assembly have printed circuit board (PCB) tails on their terminating ends. The contact assembly must mate with existing triaxial contact assemblies.

Triaxial contact assemblies heretofore known in the art have three contacts separated by dielectric insulators, and the three conductors of a triaxial cable separated by a suitable dielectric material are crimped to corresponding terminating ends of the contacts via bushings or the like.

Prior art contact assemblies of the type described have more components than is desirable; require the dielectric insulators to be bonded to outer and intermediate contacts; require all three contacts to be selectively annealed; are longer and heavier than might otherwise be desired; and require wire stripping, crimping or assembly, as the case may be, to be accomplished by the ultimate user. The triaxial contact assembly of the present invention eliminates these obvious disadvantages.

SUMMARY OF THE INVENTION

This invention contemplates a triaxial contact assembly for termination to printed circuit boards and the like, wherein a printed circuit board tail is press fitted into an intermediate contact. Another printed circuit board tail is formed as an integral part of an inner contact. When the contact assembly is installed in a ground plane connector, the printed circuit board tails of the intermediate and inner contacts extend out of the ground plane connector for termination to a printed circuit board. The arrangement is such that the outer contact of the contact assembly contacts the ground plane of the connector instead of having the outer conductor of a triaxial cable crimped to its outside diameter via a bushing or the like as has heretofore been required. The inner and intermediate contacts and associated dielectric insulators are retained by a cap which abuts a surface on the inner contact to hold the contacts and insulators fully forward. The cap is crimped in place near the rear of the outer contact.

Accordingly, there is disclosed and claimed herein a triaxial contact assembly for termination to printed circuit boards and the like, comprising: an outer contact; an intermediate contact concentrically disposed within the outer contact; an outer dielectric insulator concentrically disposed between the outer and intermediate contacts; an inner dielectric insulator concentrically disposed between the intermediate and inner contacts; the intermediate and inner contacts each carrying printed circuit board tails; a cap concentrically disposed within the outer contact for holding the intermediate and inner contacts and the inner and outer insulators forward the outer contact; and means for holding the cap in place near the rear of the outer contact.

DETAILED DESCRIPTION OF THE INVENTION

Figure 1:
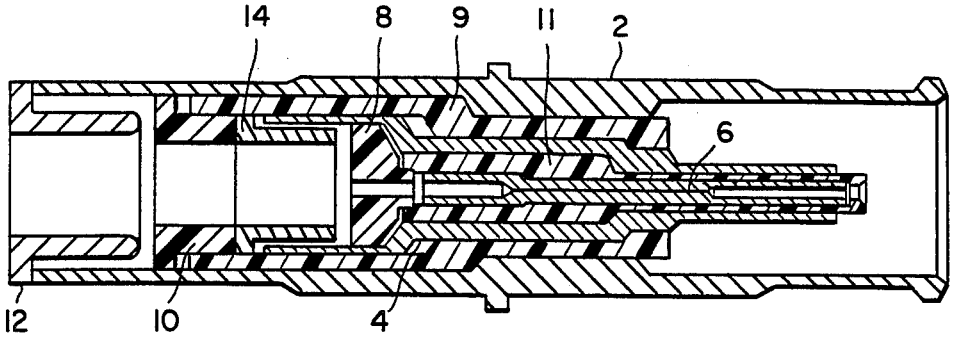
FIG. 1 PRIOR ART
FIG. 1 is a longitudinal sectioned view of a triaxial socket contact assembly configured in accordance with the prior art.

With reference to FIG. 1, the prior art triaxial contact assembly illustrated therein includes an outer socket contact 2, and intermediate pin contact 4 and an inner socket contact 6. Insulators 8 and 9 and 10 and 11 insulate the respective contacts as will be discerned from the Figure.

A triaxial cable having three conductors separated by dielectric material as is well known in the art (not otherwise shown) is crimped to the terminating ends of the outer, intermediate and inner contacts of the triaxial contact assembly via bushings 12 and 14. Only as much of the prior art contact assembly has been shown and described as is necessary to distinguish it from the contact assembly of the present invention as will be next described.

Figure 2:
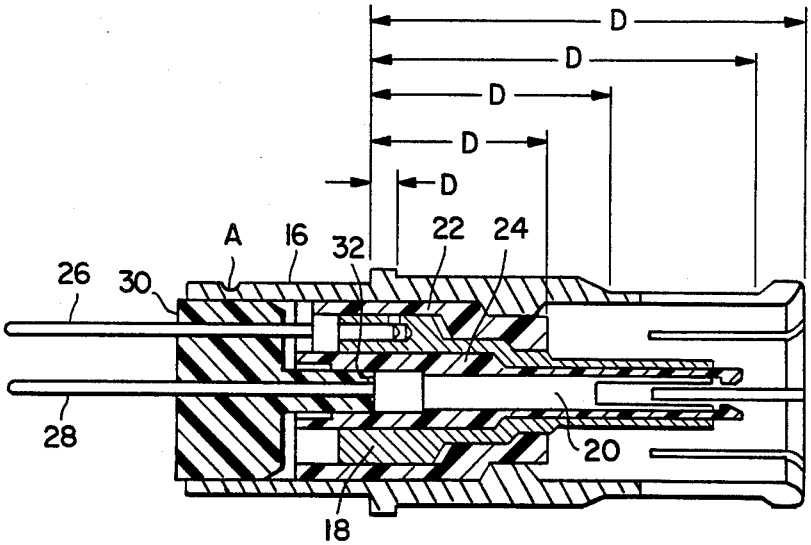
FIG. 2 is a longitudinal sectioned view of a triaxial socket contact assembly configured in accordance with the invention.

With reference to FIG. 2, the triaxial contact assembly of the present invention illustrated therein includes an outer socket contact 16, and intermediate pin contact 18 concentrically disposed within the outer contact and an inner socket contact 20 concentrically disposed within the intermediate contact. The assembly further includes a dielectric outer insulator 22 concentrically disposed between outer contact 16 and intermediate contact 18 and an inner dielectric insulator 24 concentrically disposed between intermediate contact 18 and inner contact 20.

Intermediate contact 18 has a printed circuit board tail 26 press fitted therein. Inner contact 20 is formed so as to have an integral printed circuit board tail 28.

Intermediate contact 18, inner contact 20, outer insulator 22 and inner insulator 24 are contained by a rear cap 30 of a suitable dielectric material. Cap 30 is concentrically disposed within outer contact 16 and abuts a surface 32 on inner contact 20, thereby holding the aforenoted intermediate and inner contacts and inner insulator fully forward in outer contact 16. Cap 30 is held in place by crimping near the rear of outer contact 16, such as shown at A.

When the triaxial contact assembly according to the invention as shown in FIG. 2 is installed in a ground plane connector, printed circuit board tails 26 and 28 extend out of the ground plane connector for termination to a printed circuit board or the like (not otherwise shown). Outer contact 16 contacts the ground plane of the connector instead of having the outer conductor of a triaxial cable crimped to its inside diameter via bushing 12 as will be discerned with reference to FIG. 1.

The triaxial contact assembly of the present invention as shown in FIG. 2 is considerably shorter than the prior art triaxial contact assembly as shown in FIG. 1 so as to be fully contained in the ground plane connnector. It should be noted that in fabricating the triaxial contact assembly of the invention critical dimensions designated as D in FIG. 2 are to be maintained the same as the corresponding dimensions in the prior art contact assembly shown in FIG. 1 so as to permit the aforenoted mating with existing triaxial contacts.

It will thus be seen that a triaxial contact assembly in accordance with the invention requires less components than prior art triaxial contact assemblies and hence is more economical to manufacture. Further, insulators 22 and 24 need not be bonded to the outer and intermediate contacts as is required in the prior art contact assembly, and hence two production operations are eliminated. Only intermediate contact 18 requires a selective anneal as compared to the same being required for all three contacts of the prior art contact assembly. The contact assembly of the present invention is shorter, lighter and requires less plating material; and no wire stripping, crimping or assembly operations are required by the ultimate user.

The invention has been described in terms of a triaxial contact assembly wherein the outer contact is a socket, the intermediate contact is a pin and the inner contact is a socket. It will be understood that the invention is applicable as well to other combinations of pin and socket contacts such as, for example, the outer contact being a pin, the intermediate contact being a socket and the inner contact being a pin.

With the above noted description of the invention in mind reference is made to the claims appended hereto for a definition of the scope of the invention.

What is claimed is:

1. A triaxial contact assembly for termination to printed circuit boards comprising:

an outer contact;

an intermediate contact concentrically disposed within the outer contact;

an inner contact concentrically disposed within the intermediate contact;

an outer dielectric insulator concentrically disposed between the outer and intermediate contacts;

an inner dielectric insulator concentrically disposed between the intermediate and inner contacts;

the intermediate and inner contacts each carrying printed circuit board tails;

a cap concentrically disposed within the outer contact abutting a surface on the inner contact for holding the intermediate and inner contacts and the inner and outer insulators projecting forwardly within the outer contact; and means for holding the cap in place near the rear of the outer contact.

2. A triaxial contact assembly as described by claim 1, wherein:

the printed circuit board tail carried by the intermediate contact is retained in said contact in press fit relation.

3. A triaxial contact assembly as described by claim 1, wherein:

the inner contact is formed so that the printed circuit board tail carried thereby is integral therewith.

4. A triaxial contact assembly as described by claim 1, wherein:

the outer contact is a socket contact;

the intermediate contact is a pin contact; and the inner contact is a socket contact.

5. A triaxial contact assembly as described by claim 1, wherein:

the means for holding the cap in place near the rear of the outer contact includes a crimp in the outer contact near the rear thereof.

6. A triaxial contact assembly for termination to printed circuit boards comprising:

an outer contact;

an intermediate contact concentrically disposed within the outer contact and carrying a printed circuit board tail in press fit relation therewith;

an inner contact concentrically disposed within the intermediate contact and formed so as to carry a printed circuit board tail integral therewith;

an outer dielectric insulator concentrically disposed between the outer and intermediate contacts;

an inner dielectric insulator concentrically disposed between the intermediate and inner contacts;

a cap concentrically disposed within the outer contact abutting a surface on the inner contact for holding the intermediate and inner contacts and the inner and outer insulators projecting forwardly within the outer contact; and means for holding the cap in place near the rear of the outer contact.

7. A triaxial contact assembly as described by claim 6, wherein:

the outer contact is a socket contact;

the intermediate contact is a pin contact; and the inner contact is a socket contact.

8. A triaxial contact assembly as described by claim 6, wherein:

the means for holding the cap in place near the rear of the outer contact includes a crimp in the outer contact near the rear thereof.

9. A triaxial contact assembly for termination to printed circuit boards comprising:

an outer socket contact;

an intermediate pin contact concentrically disposed within the outer socket contact and carrying a printed circuit board tail in press fit relation therewith;

an inner socket contact concentrically disposed within the intermediate pin contact and formed so as to carry a printed circuit board tail integral therewith;

an outer dielectric insulator concentrically disposed between the outer socket and intermediate pin contacts;

an inner dielectric insulator concentrically disposed between the intermediate pin and inner socket contacts;

a cap rearwardly disposed within the outer contact abutting a surface on the inner contact for holding the intermediate pin and inner socket contacts and the inner and outer insulators projecting forwardly within the outer contact; and a crimp in the outer contact near the rear thereof for holding the cap in place.

* * * * *